United States Patent [19]

Ruttgerodt et al.

[11] Patent Number: 5,048,392

[45] Date of Patent: Sep. 17, 1991

[54] ELEVATING BEARING FOR A LARGE-CALIBER WEAPON ACCOMMODATED IN THE TURRET OF A TANK

[75] Inventors: Gottlieb Ruttgerodt, Kassel; Heinrich Wolzenburg, Dortmund, both of Fed. Rep. of Germany

[73] Assignee: Wegmann & Co. GmbH, Kassel, Fed. Rep. of Germany

[21] Appl. No.: 488,588

[22] Filed: Mar. 5, 1990

[30] Foreign Application Priority Data

Mar. 15, 1989 [DE] Fed. Rep. of Germany ..... 3908346

[51] Int. Cl.[5] ..... F41G 5/24

[52] U.S. Cl. ..... 89/41.02; 89/37.07; 89/40.01

[58] Field of Search ..... 89/41.01, 41.02, 41.12, 89/41.11, 40.01, 37.07, 37.09, 40.03, 40.02

[56] References Cited

U.S. PATENT DOCUMENTS

| | | | |
|---|---|---|---|
| 40,893 | 12/1863 | Ashley | 89/41.01 |
| 2,554,019 | 5/1951 | DuBois | 89/37.09 |
| 2,712,271 | 7/1955 | Wabnitz | 89/41.01 |
| 3,889,549 | 6/1975 | Fieuzal et al. | 89/41.01 |
| 4,423,663 | 1/1984 | Politzer et al. | 89/41.02 |

FOREIGN PATENT DOCUMENTS

| | | | |
|---|---|---|---|
| 141900 | 5/1984 | European Pat. Off. . | |
| 2037819 | 2/1972 | Fed. Rep. of Germany | 89/37.09 |
| 2128703 | 1/1973 | Fed. Rep. of Germany | 89/37.07 |
| 68942 | 2/1930 | Netherlands | 89/41.01 |

*Primary Examiner*—Deborah L. Kyle
*Assistant Examiner*—Stephen Johnson
*Attorney, Agent, or Firm*—Sprung Horn Kramer & Woods

[57] ABSTRACT

An elevating bearing for a large-caliber weapon accommodated in the turret of a tank, with a slant-ring bearing around the tube. The tube is mounted in a bearing ring that rotates around the axis of the tube and is itself mounted on another bearing ring and rotates around an axis at an angle to the axis of the tube. The second bearing ring rotates in the turret around another axis at an angle to the first axis. The angle between the first and the second axes of rotation equals the angle between the first axis of rotation and the axis of the tube. Both bearing rings can be driven around their axes of rotation. The slant-ring bearing is a subassembly inside the turret and the flange that secures the second bearing ring is secured stationary to the turret. The flange that the tube is mounted on and that secures the first bearing ring is secured non-rotating to the turret. At least one mechanism that rotates the bearing rings at the same time and to the same extent but in opposite directions is also secured non-rotating to the turret.

5 Claims, 4 Drawing Sheets

ELEVATING BEARING FOR A LARGE-CALIBER WEAPON ACCOMMODATED IN THE TURRET OF A TANK

BACKGROUND OF THE INVENTION

The invention concerns an elevating bearing for a larger-caliber weapon accommodated in the turret of a tank, with a slant-ring bearing around the tube wherein the tube is mounted in a bearing ring that rotates around the axis of the tube and is itself mounted on another bearing ring and rotates around an axis at an angle to the axis of the tube, whereby the second bearing ring rotates in the turret around another axis at an angle to the first axis, and whereby the angle between the first and the second axes of rotation equals the angle between the first axis of rotation and the axis of the tube and both bearing rings can be driven around their axes of rotation.

An elevating bearing is necessary to elevate the tube of a weapon mounted in the turret of a tank. The bearing makes it possible to allow for the weapon's prescribed elevation. European Exposure 0 141 900 describes a conventional elevating bearing for tanks with a rotating turret that makes it possible to keep the tube aimed at the target while the tanks is traveling over the ground in what is called stabilized-aim operation. The weapon is secured at its center of gravity by a trunnion bearing and advanced by a linear drive mechanism, which can be either a hydraulic cylinder, or a ball-roller spindle, that engages a point of rotation.

One drawback of this known version of a elevating mechanism is that, in order to maintain the driving forces within acceptable bounds, the weapon must be suspended on trunnion bearings more or less at its center of gravity. Since artillery weapons are always becoming larger and longer, the end of the tube will extend very far into the turret. Attempts have been made to compensate for this situation by increasing the rotating diameter and height of the turret or by positioning compensators inside the weapon. Both solutions, however, have the drawback of increasing the total weight of the tank.

An object of the present invention is to provide an elevating bearing for a large-caliber weapon that will make it possible to mount the weapon outside its center of gravity without affecting the output of the elevating drive mechanism. In particular, the peak forces that occur in a non-stabilized tank traveling off-road must not be taken over by the components of the drive mechanism.

An elevating bearing with the aforesaid characteristics is described in German AS 2 037 819.

The known elevating bearing, however, is not appropriate for use on tanks with a rotating turret in stabilized operation because the bearing must be mounted in the armor. During stabilized operation accordingly the large masses of armor have to be shifted too, which then makes the requisite outputs unjustifiable. Another drawback of the known system is that the armor must overlap at several points in order to ensure protection against enemy shelling, which again increases the weight.

The known system again requires either two independent drive mechanisms with the bearing rings synchronized by controls or one drive mechanism that must be complicatedly coupled to the two rings by way of several moving parts. This known embodiment accordingly requires a total of three crown gears operating in conjunction with a pinion and a counter gear. This results in three tooth-engagement points with corresponding imprecision. The resilient bearing of the crown gear leads to additional imprecision.

SUMMARY OF THE INVENTION

The main object of the invention is to improve an elevating bearing of the aforesaid type to the extent that it is appropriate for stabilized operation in tanks with rotating turrets in that the masses that must be accelerated during that phase of operation are considerably reduced.

This object is attained in accordance with the invention in that the slant-ring bearing is a subassembly inside the turret and the flange that secures the second bearing ring is secured stationary, the flange that the tube is mounted on and that secures the first bearing ring is secured non-rotating, and at least one mechanism that rotates the bearing rings at the same time and to the same extent but in opposite directions is also secured non-rotating to the turret.

Another object is to provide the drive mechanism with at least one pinion with an axis of rotation in the radial bearing plane between the two bearing rings and engaging facing teeth in the rings.

A further object is to provide the motor mounted on an intermediate ring that is secured non-rotating in the turret with the two bearing rings rotating in it.

A still further object is to provide the bearing rings as oppositely rotating rotors in an annular motor positioned directly between them.

Still another object is to provide the motor as a double electric torque-ring motor.

The basic theory of the present invention is that the slant-ring bearing is a separate subassembly and accordingly separate from the armor, which considerably decreases the masses that have to be accelerated. Another result is that the conventional elevation armor can be applied to the turret. The non-rotating attachment of the flanges to the weapon, to the turret, and to the drive mechanism makes the slant-ring bearing light and stable enough for use in stabilized operation on tanks with a rotating turret. Driving the two bearing rings in opposite directions with the same mechanism makes the overall subassembly small and compact, saving not only space in the crew compartment but also weight. A particular advantage is that the necessary radian measure at the inner end of the weapon is substantially smaller and the distance that must be traveled by the loading mechanisms is accordingly shorter. Another advantage is that the reaction on the drive mechanisms from the mass acceleration of the weapon while the tank is moving are much weaker than in the conventional trunnion bearings. In unstabilized operation, when the weapon is at the upper or lower limit, there is no reaction from the forces of mass acceleration due to the tank pitching and hence no transmittal from the weapon onto the drive mechanisms because the slant-ring bearing transmits the forces directly into the turret flange in this position.

Another particular advantage of the elevating bearing in accordance with the invention is that there is no need to cushion or stop the drive mechanism in its limiting positions because the relationship between the path of elevation and the drive mechanism is sinusoidal. When tensioned bearings are employed for the slant-ring bearing in conjunction with a tensioned drive mechanism, the drive mechanism will be tightly mounted, entailing greater stabilization and more precise aiming than has previously been possible with trunnion bearings.

The elevating bearing in accordance with the invention also makes it possible, due to the direct engagement of a pinion with the teeth in the bearing rings, to considerably decrease the number of moving parts and hence attain an even more precise aim.

Embodiments of an elevating bearing in accordance with the invention will now be described in detail with reference to the drawings, wherein

DETAILED DESCRIPTION OF THE INVENTION

Figure 1:
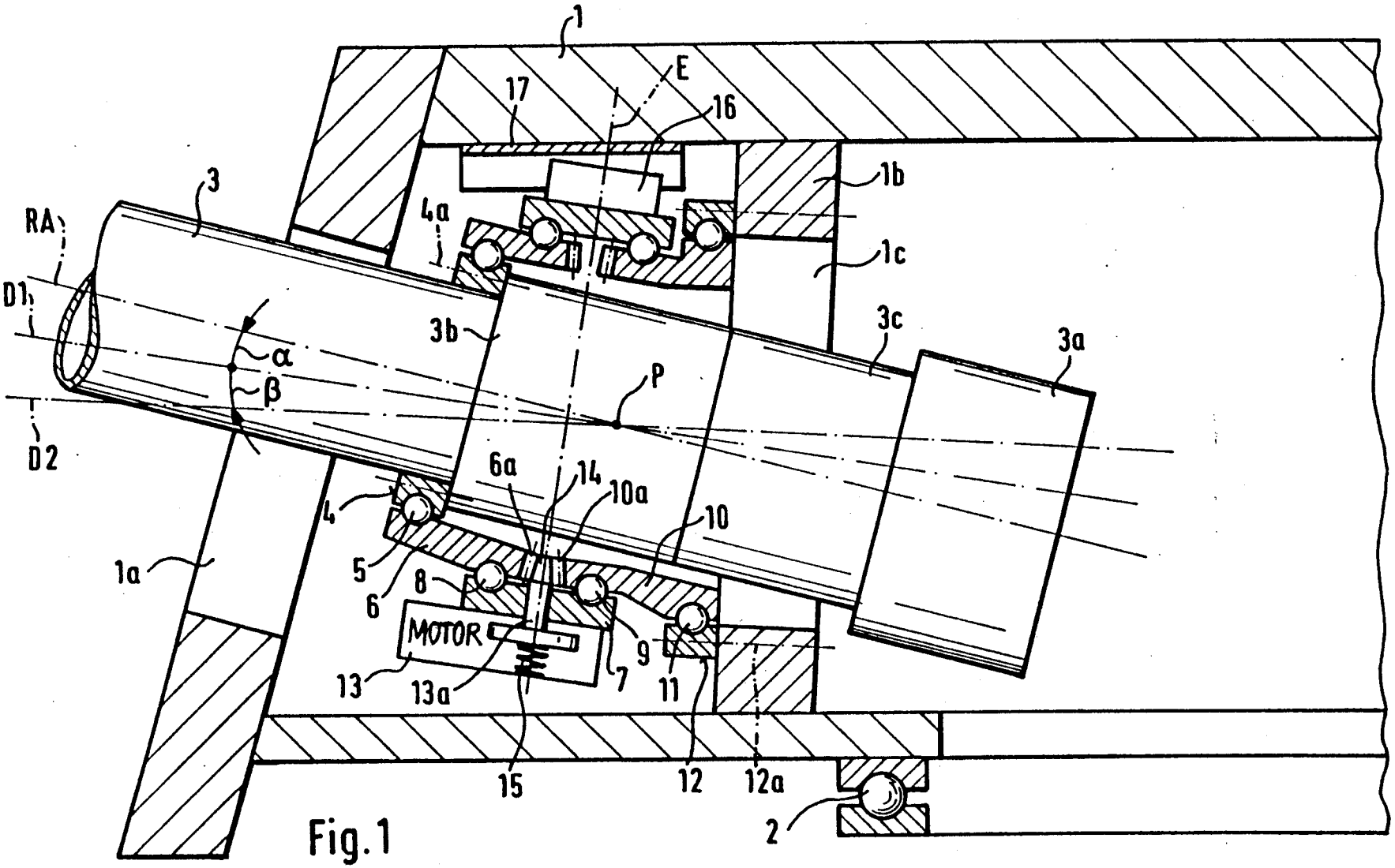
FIG. 1 is a highly schematic longitudinal section through the turret of a tank, illustrating an elevating bearing for a large-caliber weapon, showing the weapon elevated.

FIG. 1 is a section through a turret 1, which is mounted on a crown gear 2 on an unillustrated tank. The turret accommodates a large-caliber weapon 3 with one end 3*a* extending into the crew compartment and with the other extending out through an unillustrated slot la protected by conventional armor.

Weapon 3 is suspended in turret 1 on a slant-ring bearing that surrounds its tube 3. The slant-ring bearing has a flange 4 that is secured by screws 4*a* to a cradle cylinder that surrounds tube 3. Mounted on ball or roller bearings 5 on flange 4 is a bearing ring 6. One end of bearing ring 6 rotates around the axis RA of tube 3. The other end of bearing ring 6 rotates on other ball or roller bearings 8 in an intermediate ring 7 around an axis D1 of rotation. Another bearing ring 10 rotates opposite first bearing ring 6 on other ball or roller bearings 9 in intermediate ring 7 around axis D1 of rotation. The other end of second bearing ring 10 rotates on ball or roller bearings 11 in another flange 12 around another axis D2 of rotation. Flange 12 is secured by screws 12*a* to the bulkhead 1*b* of turret 1.

Flange 4, which tube 3 is mounted on, is also secured non-rotating to turret 1 with the rear section 3*c* of cradle cylinder 3*b* in the form of a square that fits into a slot 1*c* in bulkhead 1*b*.

Intermediate ring 7 is also positioned such that it cannot rotate on turret 1 but can pivot in that it has a guide 16 that extends into a mount 17 positioned on turret 1 and having a longitudinal groove.

Positioned on intermediate ring 7 is at least one motor 13 with its shaft 13*a* driving a pinion 14 that is forced by a spring 15 into the space between bearing rings 6 and 10 and tight against the teeth 6*a* and 10*a* on the facing ends of the two rings.

The three axes of rotation in the slant-ring bearing, the axis RA of tube 3, first axis D1 of rotation, and second axis D2 of rotation are at acute angles $\alpha$ and $\beta$ to one another. Axes D1 and D2 intersect at a point P on axis RA. As evidenced by known kinematic and geometric considerations, the angle between first axis D1 of rotation and the axis RA of tube 3 must for this purpose equal the angle between second axis D2 of rotation and axis D1. Subject to these conditions it becomes possible by rotating the two rings to the same extent but in opposite directions to pivot the non-rotating weapon 3 within a vertical plane.

The mechanism that drives bearing rings 6 and 10 to the same extent but in opposite directions comprises the pinion 14 positioned between rings 6 and 10 in the radial bearing plane E of intermediate ring 7. The number of teeth 6*a* in first bearing ring 6 equals the number of teeth 10*a* in second bearing ring 10. Spring 15 ensures a tight fit.

Figure 2:
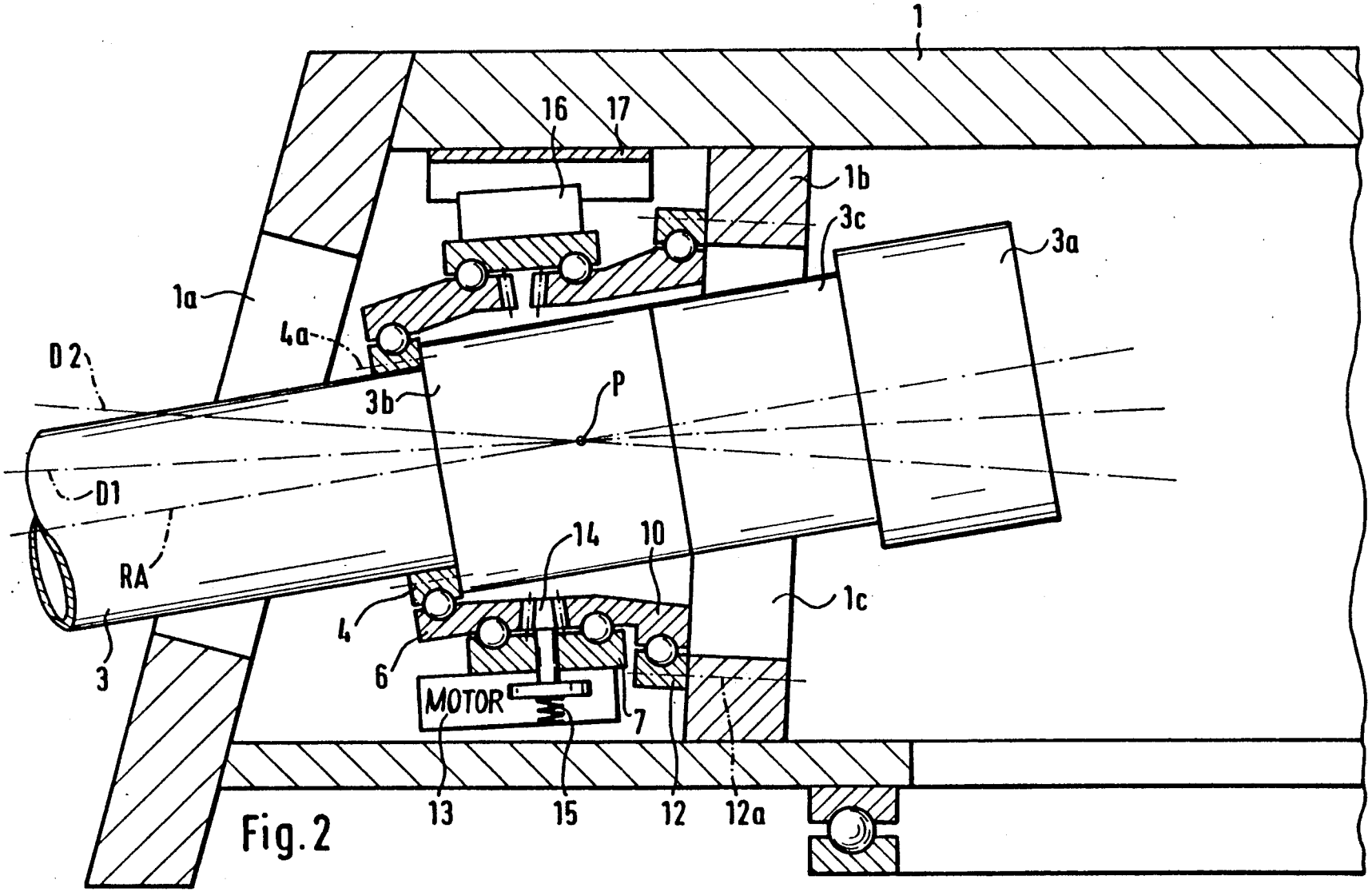
FIG. 2 is a similar illustration showing the weapon depressed.

Rotating rings 6 and 10 in opposite directions with motor 13 pivots tube 3 from the position illustrated in FIG. 1 into the position illustrated in FIG. 2 for example and vice versa. Guide 16 will simultaneously move along the groove in mount 17 as will be evident from the drawings.

Bearing rings 6 and 10 can of course be different from those illustrated in FIGS. 1 and 2. They can for example comprise oppositely rotating rotors in a motor positioned directly between them. This motor can be a double electric torque-ring motor.

Figure 3:
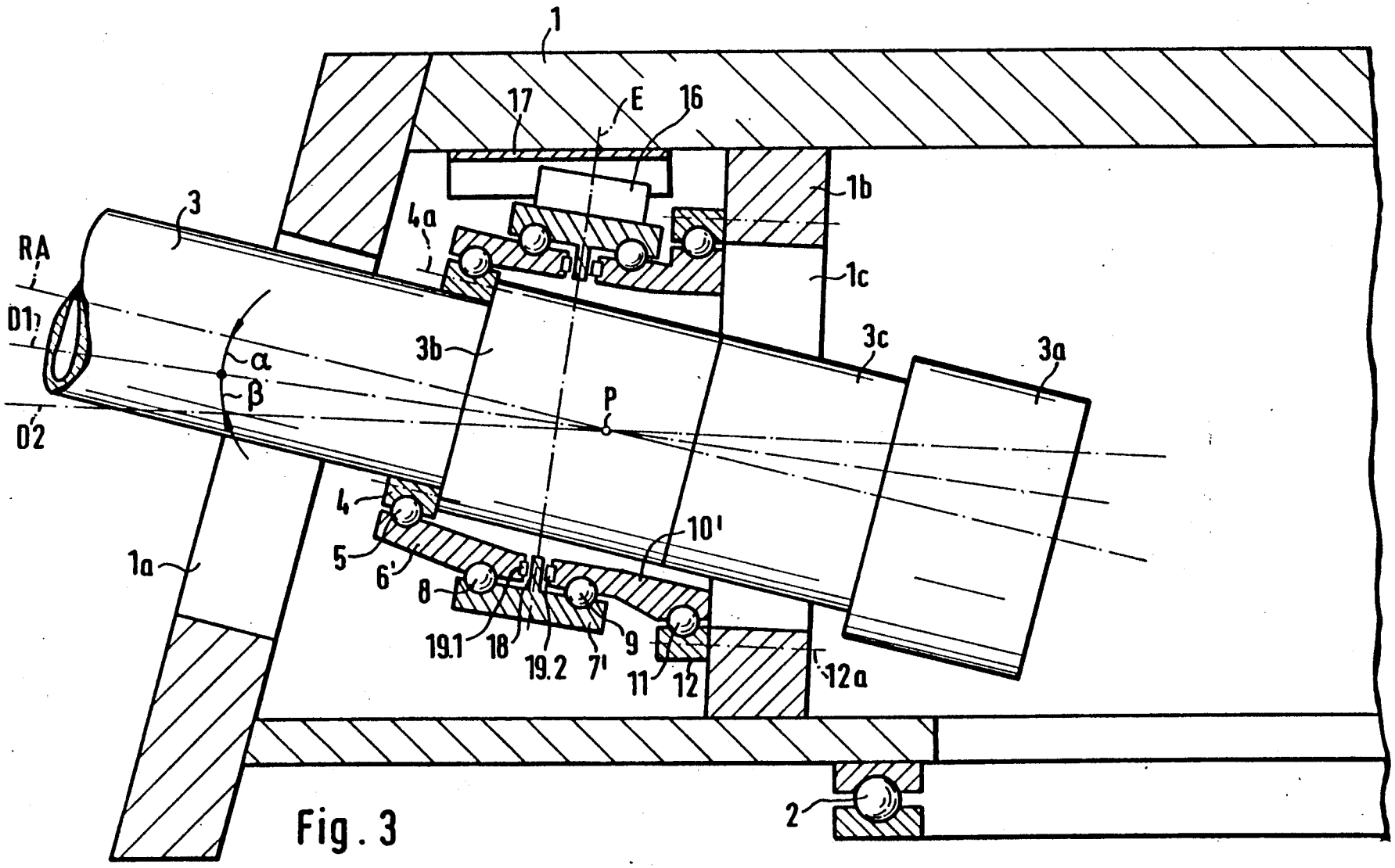
FIG. 3 is a similar illustration showing an embodiment of the elevating bearing with an integrated ring motor.
Figure 4:
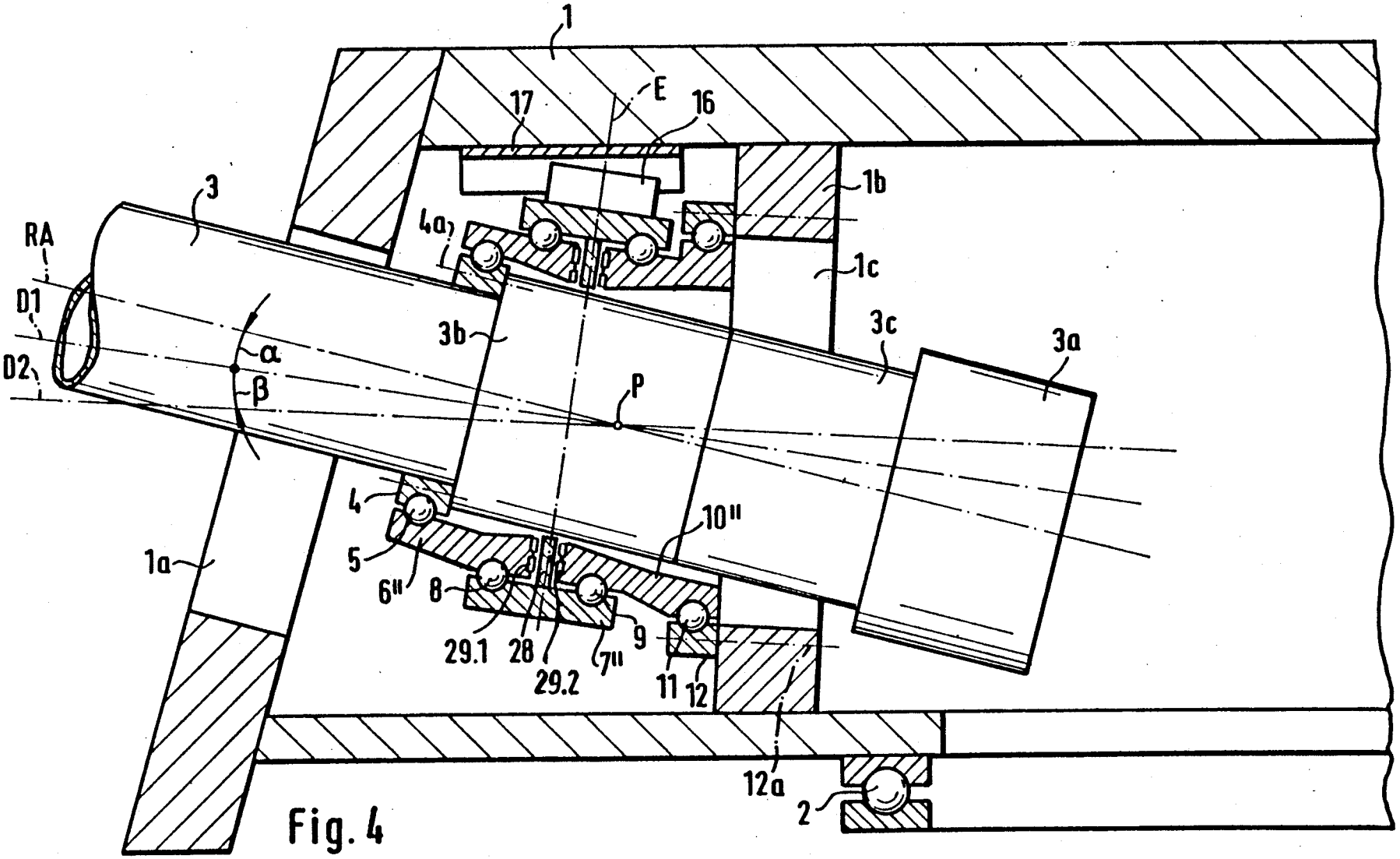
FIG. 4 is a similar illustration of another embodiment of the elevating bearing with an integrated double electric torque-ring motor.

Embodiments of this type are illustrated in FIGS. 3 and 4, wherein similar parts are labeled with the same numbers.

The embodiment illustrated in FIG. 3 differs from that illustrated in FIGS. 1 and 2 in that the two bearing rings 6' and 10' have the rotors 19.1 and 19.2 in a ring motor on their facing edges. The motor's stator 18 is positioned on an intermediate ring 7' between the two bearing rings. Stator 18 drives the two rotors in opposite directions.

The embodiment in FIG. 4 differs from that in FIGS. 1 and 2 in that the stator 28 of a torque-ring motor is positioned on an intermediate ring 7'' between the two bearing rings 6'' and 10''. The two rotors 29.1 and 29.2 are positioned on the facing sides of bearing rings 6'' and 10''. Stator 28 again drives rotors 29.1 and 29.2 in opposite directions.

What is claimed is:

1. A device for elevating a large-caliber weapon having a tube in a turret of a tank, comprising:

a slanting bearing subassembly inside the turret and comprising a first flange secured non-rotatably to the tube and mounted non-rotatably with respect to the turret, a second flange secured rigidly and non-rotatably to the turret, a first bearing ring mounted at one end on the first flange for rotation about a first axis coincident with an axis of the tube, a second bearing ring mounted at one end on the second flange for rotation about a second axis at a first given angle with respect to the first axis of the tube, means mounting another end of the first and second bearing rings for rotation around an axis at a second given angle to the first axis which is equal to one half of the first given angle; and at least one mechanism non-rotatably mounted in the turret for rotatably driving said another end of the first and second bearing rings in equal amounts simultaneously in opposite directions.

2. The device as in claim 1, wherein the at least one drive mechanism has at least one pinion with an axis of rotation in a radial bearing plane (E) between the first and second bearing rings and engaging facing teeth in the rings.

3. The device as in claim 1, wherein the means mounting said another end of the first and second bearing rings comprises an intermediate ring mounted non-rotatably in the turret and wherein the at least one drive mechanism comprises a motor mounted on the intermediate ring.

4. The device as in claim 1, wherein the first and second bearing rings comprise oppositely rotating rotors with an annular stator positioned directly therebetween and constituting a motor.

5. The device as in claim 4, wherein the motor is a double electric torque-ring motor.

* * * * *